United States Patent [19]

Hayden

[11] 4,055,734

[45] Oct. 25, 1977

[54] KEYBOARD SWITCH ASSEMBLY WITH HINGED PUSHBUTTONS AND CANTILEVERED TERMINAL MEMBERS

[76] Inventor: Thomas John Hayden, 2244 Mesa Verde Drive, Milpitas, Calif. 95035

[21] Appl. No.: 594,981

[22] Filed: July 11, 1975

Related U.S. Application Data

[63] Continuation of Ser. No. 428,348, Dec. 26, 1973, abandoned.

[51] Int. Cl.[2] ..... H01H 13/14; G06C 7/02

[52] U.S. Cl. ..... 200/5 A; 200/159 A; 200/329; 200/340; 235/145 R

[58] Field of Search ..... 200/1 R, 1 A, 1 TK, 200/5 R, 5 A, 67, 159 R, 159 A, 159 B, 329, 330, 339, 340; 197/98; 235/145 R

[56] References Cited

U.S. PATENT DOCUMENTS

| | | | |
|---|---|---|---|
| 3,068,335 | 12/1962 | Gregg | 200/246 |
| 3,205,754 | 9/1965 | Becwar | 84/433 |
| 3,258,571 | 6/1966 | Schmidt, Jr. | 200/283 |
| 3,309,487 | 3/1967 | Fisher | 200/340 |
| 3,388,226 | 6/1968 | Willcox | 197/98 UX |
| 3,526,355 | 9/1970 | Anderson | 235/145 R X |
| 3,548,131 | 12/1970 | Piber | 200/67 |
| 3,582,594 | 6/1971 | Twyford | 200/340 |
| 3,612,802 | 10/1971 | Beadle et al. | 200/340 X |
| 3,627,935 | 12/1971 | Spievak | 200/5 R |
| 3,797,357 | 3/1974 | Thomas et al. | 84/433 X |
| 3,800,104 | 3/1974 | Lien et al. | 200/5 A |
| 3,823,309 | 7/1974 | Caruso | 200/5 A X |
| 3,856,998 | 12/1974 | Sims, Jr. | 200/159 R X |

FOREIGN PATENT DOCUMENTS

| | | | |
|---|---|---|---|
| 2,459,464 | 6/1975 | Germany | 200/159 B |
| 1,259,356 | 1/1972 | United Kingdom | 200/339 |

OTHER PUBLICATIONS

IMB Technical Disclosure Bulletin, R. G. Cross, "Keyboard Overlay," vol. 15, No. 1, p. 31, June, 1972.

IBM Technical Disclosure Bulletin, D. O. Johnson, Jr., "Keyboard With Changeable Encoding and Key Designation," vol. 13, No. 7, Dec. 1970, pp. 2041, 2042.

*Primary Examiner*—James R. Scott

*Attorney, Agent, or Firm*—Thomas H. Olson

[57] ABSTRACT

A keyboard switch assembly having an apertured plate, a plurality of pushbuttons supported in the apertures and a hinge for so supporting the pushbuttons that is integral with both the panel and the pushbuttons. The hinge has a web extending between the panel and the pushbutton, and the web is formed with a plurality of grooved portions at which the web deforms in response to the reciprocable movement of the pushbutton within its associated aperture to permit a degree of reciprocable and lateral movement of the pushbutton within the aperture. Switch contacts having operative portions secured to the pushbutton so that the contacts are moved to make or break an electric circuit in response to reciprocable movement of the pushbutton relative the panel.

4 Claims, 10 Drawing Figures

Fig. 2
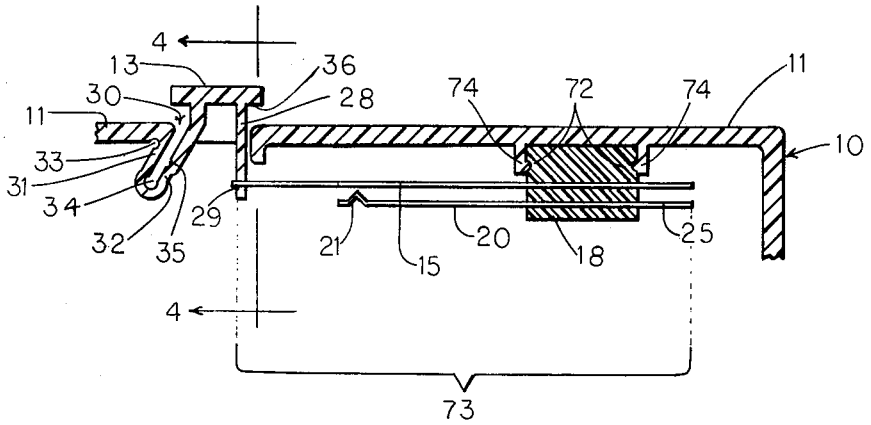
Fig. 3
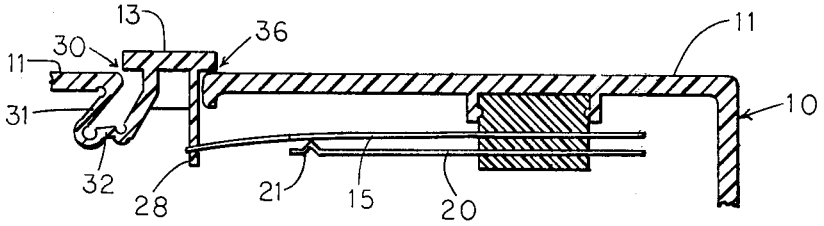
Fig. 4
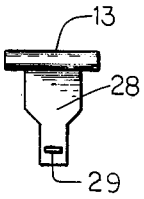
Fig. 5
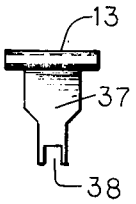
Fig. 6
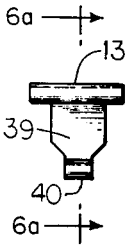
Fig. 6a
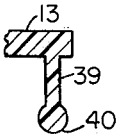
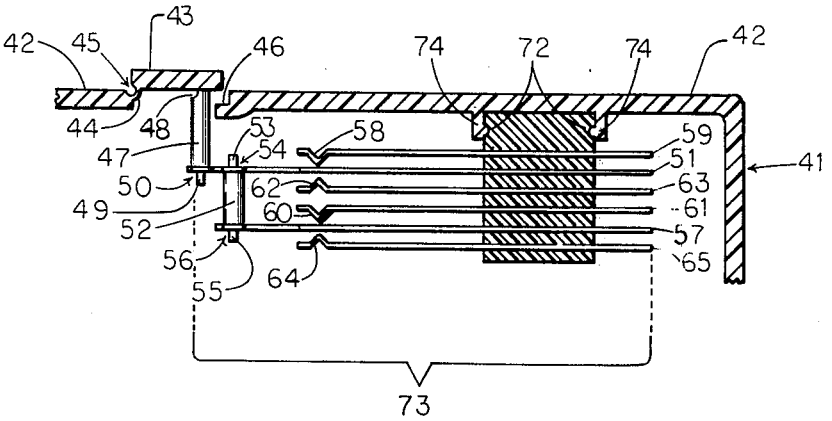
Fig. 7

KEYBOARD SWITCH ASSEMBLY WITH HINGED PUSHBUTTONS AND CANTILEVERED TERMINAL MEMBERS

CROSS REFERENCE TO RELATED APPLICATION

This application is a Continuation of U.S. patent application Ser. No. 428,348, filed Dec. 26, 1973, now abandoned, for Keyboard Switch Assembly with Hinged Pushbuttons and Cantilever Terminal Members.

BACKGROUND OF THE INVENTION

Field of the Invention

This invention relates to an electrical keyboard switch assembly and in particular to a pushbutton keyboard whose top panel and included hinged pushbuttons are formed as a unitary molded structure, wherein the manual depression of any of said pushbuttons moves a cantilevered moveable terminal element into contact with a cooperating cantilevered fixed terminal element, thus effecting an electrical impulse corresponding to the character selected.

Prior Art

There are presently many types of electrical keyboards which have been described, some of which are now in use. These types include: pushbutton assemblies with slide action switches, snap action switches and the like, some including printed circuit boards, elastomeric keyboards, conical disc contact types, and others. Whereas certain applications of each of these types give satisfactory results in certain applications, they all have certain and specific deficiencies which it is the object of my invention to overcome.

Known devices require a multiplicity of component parts, with attendant cost thereof, each component adding to the probability of component failure, and therefore keyboard failure. The assembly time also adds appreciably to production costs. Additional deficiencies with known devices are the high initial costs of components used in certain keyboards; the widespread use in certain applications of printed circuit boards which are particularly vulnerable to vibration and shock, and are not particularly reliable, the nature of construction which does not readily lend itself to ruggedness in service; the low amperage rating attendant with such designs; the complexity of keyboards, especially those which are intended for a multi-pole, multi-throw capability; and complete lack of such capability in others. In the case of diaphragm equipped keyboards, bounding is a problem, and the snap action of the discs increases the probability of metal fatigue and attendant failure.

There has been a dramatic increased need for cost reduction in keyboards in view of the proliferation of consumer products requiring keyboards, such as the tone generators presently used in telephone instruments, the electronic calculator, and the electronic typewriter (which requires multi-pole, multi-throw capability) which is presently under development; as well as the inboard computer systems presently under development for the automotive industry which will, in some instances, require a high amperage capability in future generation keyboards.

It is the object of this invention to provide a low cost, rugged, high amperage capacity, multi-pole, multi-throw capability, electrical keyboard, which is ideally suited for mass production, and which is of such low cost as to make direct replacement of the unit faster and more economical than the repair of a comparable unit, in accordance with present service practices and desirabilities.

SUMMARY OF THE INVENTION

The present invention provides a keyboard switch assembly with a top panel, a plurality of independently operable pushbuttons attached to the panel with hinges, the entire structure being formed as a unitary molded structure of a flexible plastic. On the underside of each of the pushbuttons is a perpendicular actuator arm which is coupled to a first free end of one of a plurality of flexible cantilevered moveble terminal elements of a contact lever block assembly. The other end of the moveable terminal elements are embedded in a dielectric contact lever block and protrude through the block for wire attachment to associated circuitry. Below each moveable terminal element is a cooperating fixed terminal element, with a raised contact point, which is similarly attached to the contact lever block. In a first embodiment, the moveable terminal elements are all grouped together and the fixed terminal elements are similarly grouped together, with each group comprising a plurality of substantially parallel laterally spaced individual elements. In an alternate embodiment, a plurality of groups of moveable terminal elements and a plurality of groups of fixed terminal elements are provided.

In operation, when a pushbutton is depressed, the corresponding actuator arm is moved downward, which in turn moves the associated moveable terminal element downward into contact with the raised contact point of the cooperating fixed terminal element, thus completing an electrical circuit.

The contact lever block assembly is fabricated by blanking the moveable and fixed terminal elements from sheet stock with the wire attachment end joined to a connector strip, forming contact points on the free ends of the fixed terminal elements, heat treating the terminal elements to provide a desired degree of flexibility, arranging the grouped terminal elements in spaced alignment in a mold, molding an insulative block about the terminal elements adjacent the wire attachment ends with the latter protruding from the block, and removing the connector strips by shearing, blanking or twisting. To ensure firm bonding of the terminal elements in the block so that these elements are restricted from longitudinal or lateral movement in a completed assembly, those portions of the individual terminal elements which are bonded in the block are laterally offset from the parallel longitudinal axes of the remaining portions during the blanking step. In addition, the outermost ones of the individual terminal elements in a given group are provided with an outwardly laterally extending tab portion having an alignment aperture for facilitating alignment of grouped terminal elements prior to molding the block. Also, to facilitate electrical connection of the terminal elements to associated circuitry, the wire attachment ends of these elements are provided with a central aperture and an edge notch, and are formed in a shape compatible with existing female connectors, so that the finished contact lever block assembly may be used in applications requiring either wire soldering or removable plug connections.

For a fuller understanding of the nature and advantages of the invention, reference should be had to the ensuing detailed description taken in conjunction with the accompanying drawings.

DESCRIPTION OF THE DRAWINGS

FIG. 2 is a sectional view taken substantially along the line 2—2 of FIG. 1, showing the pushbutton in the uppermost position.

FIG. 3 is a sectional view taken substantially along the line 2—2 of FIG. 1, similar to FIG. 2, showing the pushbutton in the depressed position.

FIG. 4 is an elevational view taken substantially along the line 4—4 of FIG. 2.

FIG. 5 is an elevational view of a pushbutton with an alternative actuator arm and taken substantially along the line 4–4 of FIG. 2.

FIG. 6 is an elevational view of a pushbutton with another alternative actuator arm taken substantially along the line 4—4 of FIG. 2.

FIG. **6*a* is a sectional view taken along the lines 6*a*—6*a* of FIG. 6**.

Figure 1:
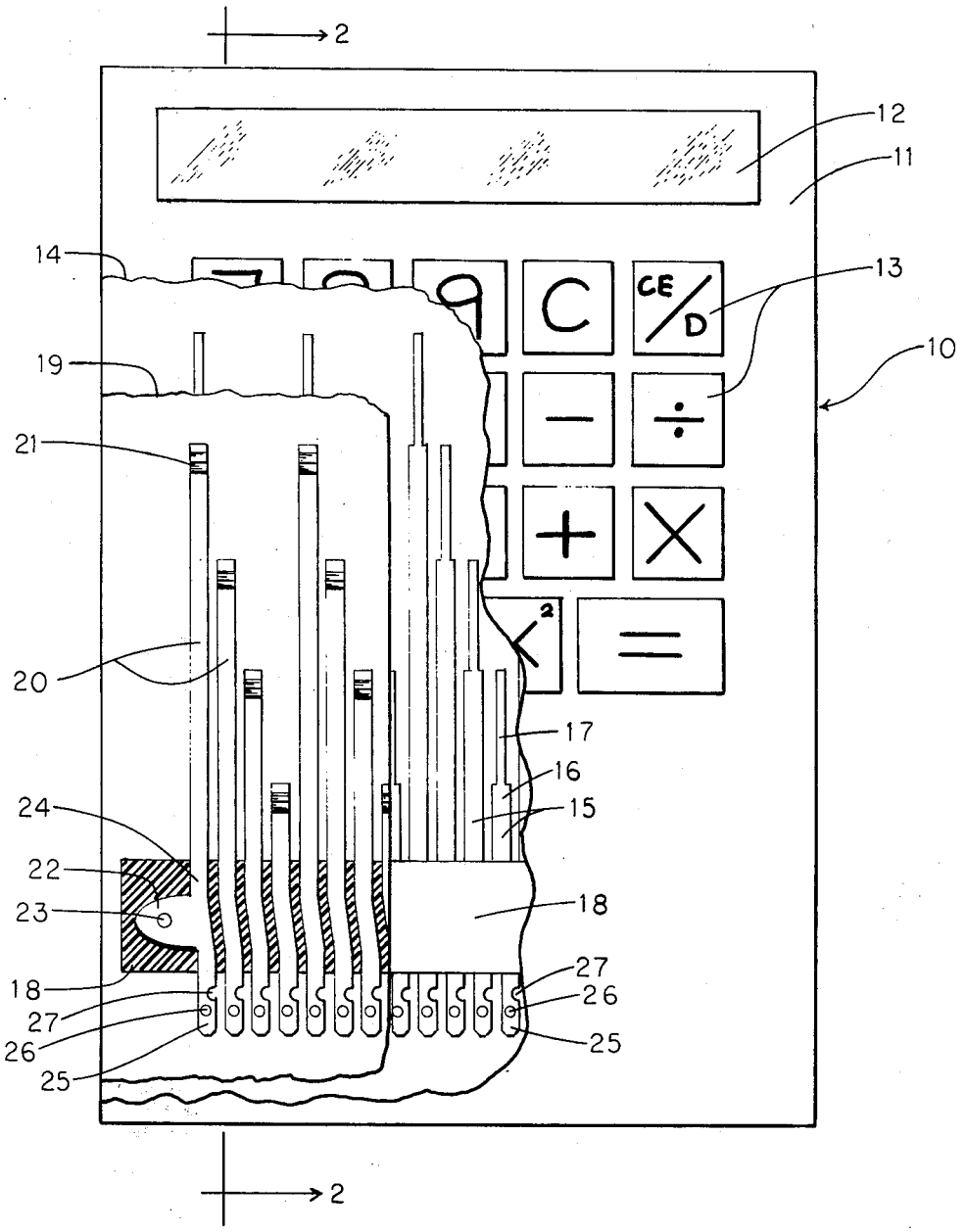
FIG. 1 is a top plan view, partially broken away, of a preferred embodiment of the invention showing the moveable terminal elements, and the fixed terminal elements.

FIG. 7 is an elevational view of an alternative switching assembly taken substantially along the line 2—2 of FIG. 1.

Figure 8:
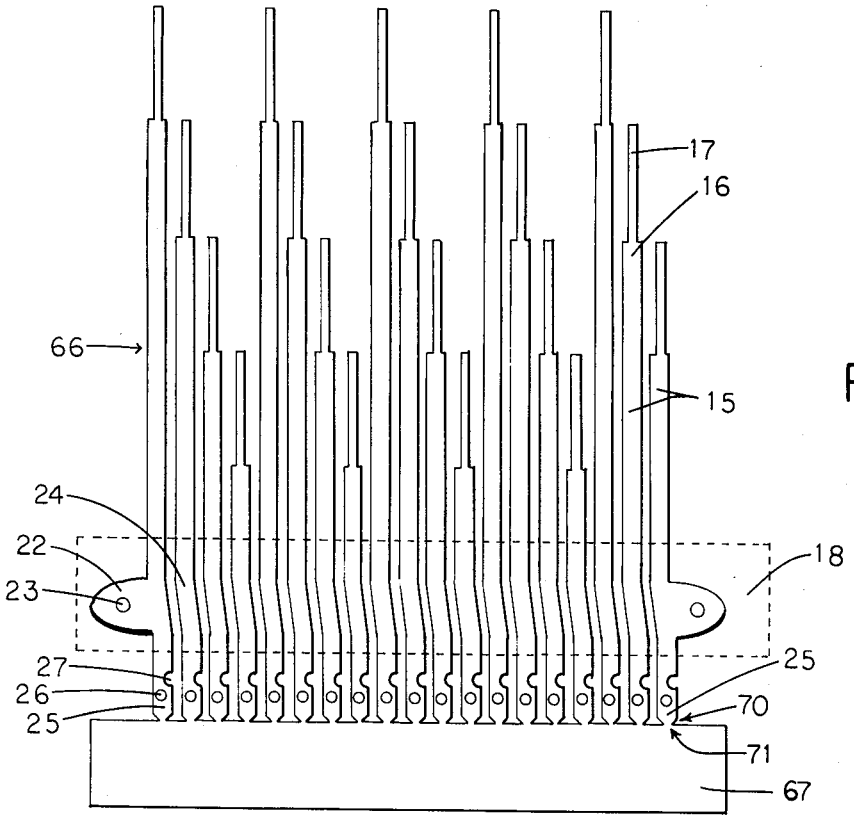

FIG. 8 is a plan view of the moveable terminal plate, and including a phantom view of the terminal block.

Figure 9:
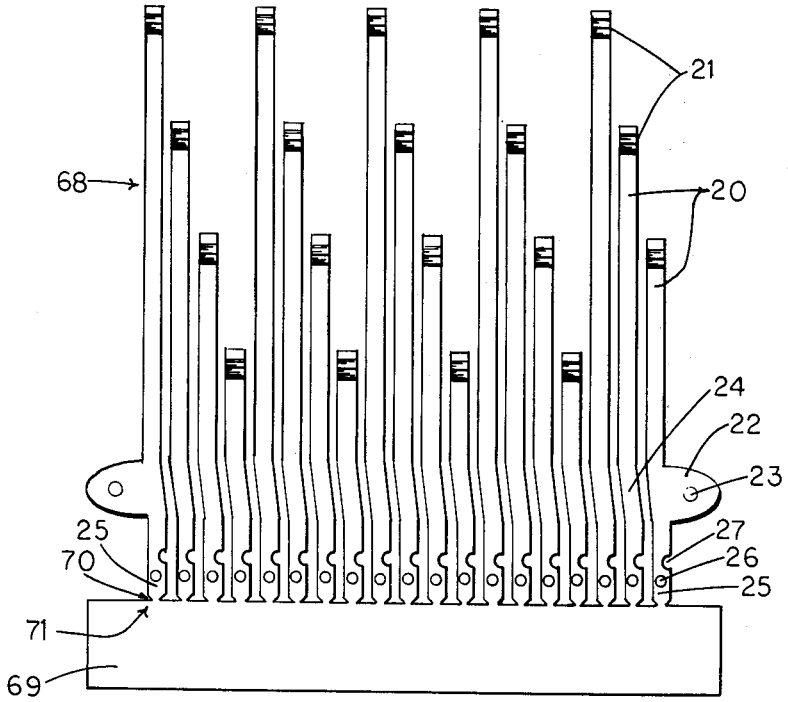

FIG. 9 is a plan view of the fixed terminal plate.

Similar reference numerals are employed throughout the several views of the drawings to identify corresponding component parts and features. The physical dimensions of certain of the component parts and features, as illustrated in the drawings, have been modified, exaggerated, or both, for purposes of clarity of illustration.

DESCRIPTION OF THE PREFERRED EMBODIMENTS

FIG. 1 illustrates a keyboard constructed in accordance with the invention, incorporated in an electronic calculator 10, which includes a top panel 11, an optoelectronic display panel 12, and a plurality of pushbuttons 13 provided with embossed numeric/function indicia to define pushbutton function. The top panel 11 and the pushbuttons 13 are formed as a unitary molded structure as will be explained in greater detail below.

The top panel 11 is shown as being broken away substantially along the line 14, revealing moveable terminal elements 15 which are fabricated of plated spring steel, or the like. Moveable terminal elements 15 are provided with a first portion 16, hereinafter termed a secondary flexing element and a second narrower portion 17, termed a primary flexing element. The lengths of secondary flexing elements 16 vary depending on the position of the associated pushbutton 13 on the panel 11. The lengths of the primary flexing elements 17, on the other hand, are all substantially equal so that when the associated pushbutton is actuated in the method described below the actuation force requirements for each of the pushbuttons 13 are of a similar magnitude. The distal end of each of the secondary flexing elements of moveable terminal elements 15 is boundably attached within a contact lever block 18.

The calculator is further shown in FIG. 1 as being broken away substantially along the line 19, revealing fixed terminal elements 20, which are provided with a formed, stamped contact point 21 shown in profile in FIG. 2. It is understood, by anyone knowledgeable in the art, that it may be desired that the commonly termed "silver contacts," or the like, can be substituted for the contact point 21, and alignedly included with the associated moveable terminal element 15. The fixed elements 20 are also boundably attached within said contact lever block 18.

The outermost moveable terminal elements 15, and the outermost fixed terminal elements 20, are provided with an alignment tab 22 which is provided with an alignment hole 23 for purposes of construction, which will be explained in greater detail below. That major portion 24 of the moveable terminal elements 15, and the fixed terminal elements 20, which are boundably attached within the contact lever block 18, are set on a bias to the contact lever block 18 in order to restrict longitudinal and lateral movements of the elements. Alternatively, serrations may be provided along the lateral and longitudinal surfaces of that portion of the moveable terminal element 15 and the fixed terminal elements 20, and more specifically those major portions 24 thereof which are intended to be included within the contact lever block 18, in order to increase the bonding properties as described above.

The moveable terminal elements 15 and the fixed terminal elements 20 are provided with a male connector end 25, which in conjunction with a female plug (not shown), provide the electrical connection between the moveable terminal elements 15 and the fixed terminal elements 20, to the electronic components of the calculator 10, as will be explained in greater detail below. It may be desired that the moveable terminal element 15 and fixed terminal element 20 assembly (hereinafter designated as the contact lever block assembly 73) be designed so as to be plugged directly into a printed circuit board or into a removable female plug connector. For alternative connection techniques, the male connector end 25 is provided with a soldering lug hole 26, and a clearance notch 27 so that a wire can be drawn up through the clearance notch 27 and inserted into the soldering lug hole 26, after which the wire can be soldered to the male connector end 25. It may be desired that the male connector ends 25 be so aligned that the centermost connector end 25 is essentially aligned at 0° to the vertical, and each adjacent and subsequently adjacent terminal element is increased by between 1° and 3° to the vertical, so that the male connector ends 25 will be substantially disposed in a fan shape, in order to increase separation distances thus enhancing soldering operations.

It will be noted that the contact lever block assembly is illustrated as being substantially disposed in a vertical alignment with the top panel 11, and is illustrated as a single structure. It may be desired that the assembly be set on a bias or disposed along any of the remaining lateral or longitudinal aspects, and it may be further desired that the assembly be divided into two or more separate assemblies as requirements dictate. It should be further noted that the moveble terminal elements 15 and the fixed terminal elements 20 are substantially linear, but it may be desired that they be angled in a horizontal or a vertical plane at any point(s) along the flexing portion.

FIG. 2 illustrates a sectional view of the electronic calculator 10 with the pushbutton 13 in the rest position. Depending from the underside of pushbutton 13 is an actuator arm 28 provided with a terminal slot 29 adjacent the distal end thereof in which the free end of primary flexing element 17 is received. The top panel 11 is provided with a hinge assembly 30 which is disposed at an angle of substantially 30° to the normal to the surface of top panel 11, which is composed of a primary hinge element 31 and a shorter secondary hinge element 32, preferably having a proportional factor of about 0.625. Hinge assembly 30 further includes a panel hinge groove 33 between the top panel 11 and the primary hinge element 31, a primary to secondary hinge groove 34 between the primary hinge element 31 and the secondary hinge element 32, and a secondary hinge element to pushbutton hinge groove 35 between the secondary hinge element 32 and the pushbuttons 13, grooves 32, 33, 34 and 35 effecting a narrowing of the material of the hinge assembly 30 to provide pivot points. The moveable terminal element 15 is constructed in such manner to provide a spring effect causing the pushbuttons 13 to be normally biased in an up position. The pushbutton 13 is provided with a lip 36 which overlaps the top panel 11 on the forward longitudinal and both lateral sides, so that the top panel 11 limits the distance to which the pushbutton 13 can be depressed.

FIG. 3 illustrates the pushbutton 13 in the fully depressed position. As shown in this figure, the pushbutton lip 36 is resting on the top panel 11, and the actuator arm 28 has depressed the moveable terminal element 15 into contact with the contact point 21 of the fixed terminal element 20. The hinge assembly 30 is pivoted at grooves 33–35 and the primary hinge element 31 is disposed at an angle of substantially 41½° to the vertical, and the secondary hinge element 32 is disposed at an angle of substantially 85° to the vertical. It may be desired that alignment grooves or the like be included on the underside of the top panel 11 in order to guide and limit the pushbutton so that the horizontal surfaces of the pushbuttons will be guided to remain substantially in a horizontal plane.

FIG. 4 illustrates the pushbuttons 13 with the included actuator arm 28, which is wider at the top half and narrows at the bottom half so that the actuator arm will give sufficient clearance to the adjacent moveable terminal elements 15. FIG. 4 further illustrates the shape of the terminal slot 29.

FIG. 5 illustrates an alternative pushbutton 13 assembly which includes an actuator arm 37 and a yoke 38 which straddles the distal end of the moveable terminal element 15.

FIGS. 6 and 6*a* illustrate another alternative pushbutton 13 assembly wherein an actuator arm 39 is provided with a generally cylindrical roller element 40, which rests on the top of the distal end of the moveable terminal element 15.

FIG. 7 illustrates an alternative keyboard assembly 41 constructed in accordance with the invention, and having a multi-pole, multi-throw capability as would be required for a telephone tone generator or the like. Keyboard assembly 41 is illustrated in a double-pole, double-throw mode, and includes a top panel 42, a pushbutton 43, single element hinge 44, a longitudinal hinge groove 45, and a pushbutton limiting recessed shoulder 46 which is incorporated into, and located on the facing longitudinal edge of that portion of the top panel 42 which is adjacent to the pushbutton 43. A generally cylindrical primary actuator arm 47 attached to and molded in conjunction with pushbutton 43 is provided with a hinge groove 48. Secured to the free end of arm 47 is an attached pin 49 which is inserted into an alignment hole 50 in a primary flexible terminal element 51. A generally cylindrical follower actuator arm 52 is provided with an upper attachment pin 53 which is inserted into an alignment hole 54 of the primary flexible terminal 51. Actuator arm 52 is further provided with a lower attachment pin 55 which is inserted into an alignment hole 56 of a secondary flexible terminal element 57. If desired the ends of the attachment pin 49, attachment pin 53 and attachment pin 55 may be crimped or heated and flattened in order to secure them to their respective alignment holes.

In operation, when the pushbutton 43 is in the up position, the primary flexible terminal element 51 is in contact with a contact point 58 of the cooperating primary normally closed fixed terminal element 59 and the secondary flexible terminal element 57 is in contact with a contact point 60 of the cooperating secondary normally closed fixed terminal element 61. When the pushbutton 43 is manually depressed it pivots on the hinge 44 substantially in the area of the groove 45, and moves downward, the downward movement being limited by contact between the pushbutton 43 and the limiting shoulder 46. As the downward force is transmitted through the primary actuator arm 47 to the primary flexible terminal element 51 this downward movement is transmitted through the follower actuator arm 52 to the secondary flexible terminal element 57, so that the primary flexible terminal element 51 is disengaged from the contact point 58 and is brought into contact with the contact point 62 of the cooperating primary normally open fixed terminal element 63, and the secondary flexible terminal element 57 is disengaged from the contact point 60 and is brought into contact with the contact point 64 of the cooperating secondary normally open fixed terminal element 65.

It is understood by anyone knowledgeable in the art that the number of flexible terminal elements and associated fixed terminal elements can be further increased by stacking with the addition of multiple followers, similar to the follower actuator arm 52 of the invention, and it is further understood that a plurality of adjacent switching assemblies can be constructed each having an actuator arm similar to the primary actuator arm 47 shown in FIG. 7 with each arm adapted to be activated by a single pushbutton.

Referring now to both FIG. 8 and FIG. 9, the male connector end 25 of both the moveable terminal element 15 and the fixed terminal element 20 is beveled in the region indicated by reference numeral 70 at an angle of about 30° to the longitudinal axis thereof, so that the point of connection 71 to the connector bar 67 of the moveable terminal plate 66 and the connector bar 69 of the fixed terminal plate 68 is of lesser width than and about one-half of the width of the moveable terminal element 15. This weakens the connection between connector bars 67, 69 and their respective finger-like elements 15, 20 to facilitate separation of the elements 15, 20 from their respective bars 67, 69 during fabrication.

Fabrication of the preferred embodiment proceeds as follows. The moveable terminal plate 66 and the fixed terminal plate 68 are each punch pressed out of suitable metal sheet stock, and the contact point 21 is shaped. Thereafter, the flexible portions of plates 66, 68 are treated in a conventional manner, e.g. alloying, tempering, plating, or the like in order to provide the desired flexibility for elements 15, 20. Plates 66, 68 are next inserted into a suitable mold for plastics which includes suitable spacers and alignment pins for insertion through the alignment holes 23. The mold includes a raised portion in order to provide adjacent grooves (see FIG. 2) along the longitudinal surfaces of the contact lever block 18. The mold is next injected with a thermoplastic or the like to form the contact lever block 18 and alignedly secure the moveable terminal plate 66 and the fixed terminal plate 68 in the general area of the major portion 24 of these elements.

The contact lever block 18 is removed from the mold, and the connector bar 67 and the connector bar 69 are grasped with pliers or the like and bent back and forth until they are separated from the terminal elements at the points of connection 71. Alternatively, connector bar 67 and the connector bar be sheared while still in the mold or may be removed from the mold and sheared with a suitable shearing machine.

The contact lever block assembly 73 is next connected to the electronic section of the calculator 10 by soldering appropriate electrical conductors from the calculator 10 to the soldering lug hole 26 of the elements 15, 20 or a female plug with included wiring harness may be plugged onto the male connector ends 25. The distal end of the primary flexing elements 17 are slidably inserted into the respective terminal slots 29, or arranged below the distal ends of the respective actuator arms 28, and the contact lever block 18 pushed into longitudinal locking ridges 74 (see FIG. 2), integral to the top panel 11 in order to secure the contact lever block assembly 73 to the top panel 11. If desired, end stops may be provided (not shown) to restrict longitudinal movement.

Further, if desired the contact lever block assembly 73 may be secured to the top panel 11 with screws or the like inserted through the alignment holes 23.

While the above provides a full and complete disclosure of the preferred embodiments of the invention, various modifications, alternate constructions and equivalents may be employed without departing from the true spirit and scope of the invention. For example, while the invention has been described in connection with an electronic calculator, this is for purposes of illustration only and it should be understood that modification and application of the invention to other devices requiring a keyboard switch assembly is contemplated. Therefore the above description and illustrations should not be construed as limiting the scope of the invention, which is defined by the appended claims.

What is claimed is:

1. A keyboard switch assembly comprising:

a panel member having an upper surface and a plurality of pushbutton apertures, an equal plurality of pushbuttons, hinge means integrally formed with said panel member and the associated pushbutton for securing the pushbutton to the panel and within the associated aperture for reciprocable movement therein in a direction normal to said upper surface, said hinge means having a folded web having a trough-like bottom opening in a direction generally toward said upper surface, said web having a first grooved portion extending along the junction between said hinge and said panel and a second grooved portion extending generally parallel with said first grooved portion in the region between said bottom and the junction between said hinge and said pushbutton, at least some of said pushbuttons each including switch actuating means extending in a first direction away from the surface of said panel; and a plurality of switch means mounted in cooperative relation with said switch actuating means, individual ones of said plurality of switch means including a switch actuating element positioned adjacent an associated one of said plurality of switch actuating means for operable connection therewith when the corresponding pushbutton is actuated.

2. A keyboard switch assembly comprising a substantially rigid panel having a planar outside surface and an inner surface substantially parallel to said outer surface, said panel defining a plurality of apertures extending between said outer and inner surfaces, an equal plurality of pushbuttons disposed in respective said apertures and extending therethrough so as to be accessible from said outer surface, a hinge integrally formed with said panel and the associated pushbutton for retaining the pushbutton in the aperture, each hinge including a folded web having a trough-like bottom that extends from said inner surface, said web having a first grooved portion extending along the junction between said hinge and said panel and a second grooved portion extending generally parallel with said first grooved portion in a region between said first grooved portion and the junction between said web and said pushbutton, so as to afford movement of said pushbutton relative said panel in a direction generally normal thereto, at least one of said pushbuttons including switch actuating means extending in a first direction away from said panel on the inner surface thereof, said switch actuating means being operable to actuate associated switch means disposed adjacent to the inner surface of said panel.

3. A keyboard switch assembly according to claim 2 wherein said web has a third grooved portion parallel to said first and second grooved portions and disposed at the junction point between said web and said pushbutton so as to afford a limited degree of lateral movement of said pushbutton in said aperture in response to movement of said pushbutton in a direction normal to said outer surface.

4. A keyboard switch assembly according to claim 3 in combination with switch means comprising a contact block fixed relative said panel remote from one of said pushbuttons, an elongate resilient movable contact having a first end fixed to said contact block and a second end remote from said first end, said second end being operably connected to said switch actuating means, and a fixed contact rigid with said contact block and cooperable with said movable contact for making and breaking a circuit therewith in response to movement of said pushbutton relative said panel.

* * * * *